US006229995B1

(12) United States Patent
Lee

(10) Patent No.: US 6,229,995 B1
(45) Date of Patent: May 8, 2001

(54) POWER CONTROL DEVICE IN RADIO TRANSMITTER

(75) Inventor: Jong-Deok Lee, Suwon-shi (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/217,981

(22) Filed: Dec. 21, 1998

(30) Foreign Application Priority Data

Dec. 19, 1997 (KR) ..... 97-70431

(51) Int. Cl.[7] ..... H01Q 11/12
(52) U.S. Cl. ..... 455/127; 455/91; 455/115
(58) Field of Search ..... 455/38.3, 127, 455/343, 78, 115, 83, 91; 375/297; 330/278

(56) References Cited

U.S. PATENT DOCUMENTS

| | | | | |
|---|---|---|---|---|
| 5,152,004 | | 9/1992 | Vaisanen et al. | 455/68 |
| 5,438,684 | * | 8/1995 | Schwent et al. | 455/127 X |
| 5,530,923 | * | 6/1996 | Heinonen et al. | 455/126 |
| 5,661,434 | | 8/1997 | Brozovich et al. | 330/51 |
| 5,909,643 | * | 6/1999 | Aihara | 455/127 |
| 6,078,794 | * | 6/2000 | Peckham et al. | 455/127 |

* cited by examiner

*Primary Examiner*—Nay Maung
(74) *Attorney, Agent, or Firm*—Dilworth & Barrese, LLP

(57) ABSTRACT

A high efficiency power control device for a radio transmitter of a radio communication system is provided which reduces noise, current consumption and the generation of spurious signals. The transmitter has a drive amplifier, a power amplifier and a duplexer. The power control device includes a divider for dividing an output of the drive amplifier into first and second power signals at a same rate. A switching element transfers the second power signal to the duplexer in response to a first control signal. The power amplifier is enabled in response to a second control signal. A control signal generator generates the first and second control signals. Further, the control signal generator activates the first control signal to enable the switching element and inactivates the second control signal to disable the power amplifier, when the transmitter transmits a low power signal. Moreover, the control signal generator inactivates the first control signal to disable the switching element and activates the second control signal to enable the power amplifier, when the transmitter transmits a high power signal.

5 Claims, 2 Drawing Sheets

POWER CONTROL DEVICE IN RADIO TRANSMITTER

BACKGROUND OF THE INVENTION

1. Field of the Invention

The present invention relates generally to transmitters for radio communication systems and, in particular, to a high efficiency power control device capable of reducing noise, current consumption and the generation of spurious signals in a radio transmitter.

2. Description of the Related Art

In a radio communication system, a terminal apparatus and a base station apparatus include a power amplifier for amplifying a low power signal to a high power signal. A CDMA (Code Division Multiple Access) or PCS (Personal Communication System) phone deals with both very low power signals and very high power signals.

FIG. 1 is a block diagram illustrating a conventional transmitter for a terminal apparatus such as the CDMA or PCS phone. An IF (Intermediate Frequency) filter 110 receives a modulated IF input transmission signal $S_{IF}$ and filters the IF transmission signal. An IF amplifier 120 amplifies the IF transmission signal, and an IF filter 130 filters an output of IF amplifier 120. A mixer 140 mixes an output of IF filter 130 with a local oscillation frequency generated from a local oscillator 150 to generate an RF (Radio Frequency) signal. An RF filter 160 filters the mixed signal to detect the RF signal. A drive amplifier 170 amplifies the RF signal in order to obtain a power signal for driving a power amplifier 190. An RF filter 180 filters an output of drive amplifier 170. The power amplifier 190 amplifies the filtered RF signal. A duplexer 220 switches an antenna 230 to a transmitting part or a receiving part. An isolator 210, which is connected between an output node of power amplifier 190 and an input node of duplexer 220, transfers an output of power amplifier 190 to duplexer 220 without attenuation in order to prevent transmission distortion from a reflected wave. An automatic power controller (APC) 200 connected between drive amplifier 170 and power amplifier 190 automatically controls a gain of power amplifier 190.

It is to be appreciated that the above structure has numerous deficiencies, particularly with respect to a linear system having a large difference between the maximum power level and the minimum power level. For example, power amplifier 190 is always driven, irrespective of whether or not the transmission power is high or low. As a result, the current consumption of the transmitter is increased. Further, since the power amplifier has variable input/output characteristics according to an applied voltage, it is difficult to obtain optimal power amplifying efficiency when the applied voltage is changed by power control. Moreover, it is difficult to control a negative voltage of GaAs FETs (Field Effect Transistors) used for the power amplifier. Additionally, it is difficult to reduce noise and the generation of spurious signals in the transmitter.

SUMMARY OF THE INVENTION

It is therefore an object of the present invention to provide a power control device capable of increasing power amplifying efficiency and reducing noise, current consumption and the generation of spurious signals in a radio transmitter.

To achieve the above and other objects, there is provided a power control device in a transmitter of a radio communication system. The transmitter has a drive amplifier, a power amplifier and a duplexer. The power control device includes: a divider for dividing an output of the drive amplifier into first and second power signals at a same rate; a switching element for transferring the second power signal to the duplexer in response to a first control signal, and wherein the power amplifier is enabled in response to a second control signal; and a control signal generator for generating the first and second control signals, wherein said control signal generator activates the first control signal to enable the switching element and inactivates the second control signal to disable the power amplifier when the transmitter transmits a low power signal, and said control signal generator inactivates the first control signal to disable the switching element and activates the second control signal to enable the power amplifier when the transmitter transmits a high power signal.

Further, the power control device may include an isolator having an input node operatively coupled to the power amplifier and the switching element and an output node operatively coupled to the duplexer. The isolator transfers outputs of the power amplifier and the switching element to the duplexer without attenuation to prevent transmission distortion from a reflected wave.

These and other objects, features and advantages of the present invention will become apparent from the following detailed description of illustrative embodiments thereof, which is to be read in connection with the accompanying drawings.

DETAILED DESCRIPTION OF PREFERRED EMBODIMENTS

A preferred embodiment of the present invention will be described hereinbelow with reference to the accompanying drawings. In the following description, well known functions or constructions are not described in detail so as not to obscure the invention.

Figure 1:
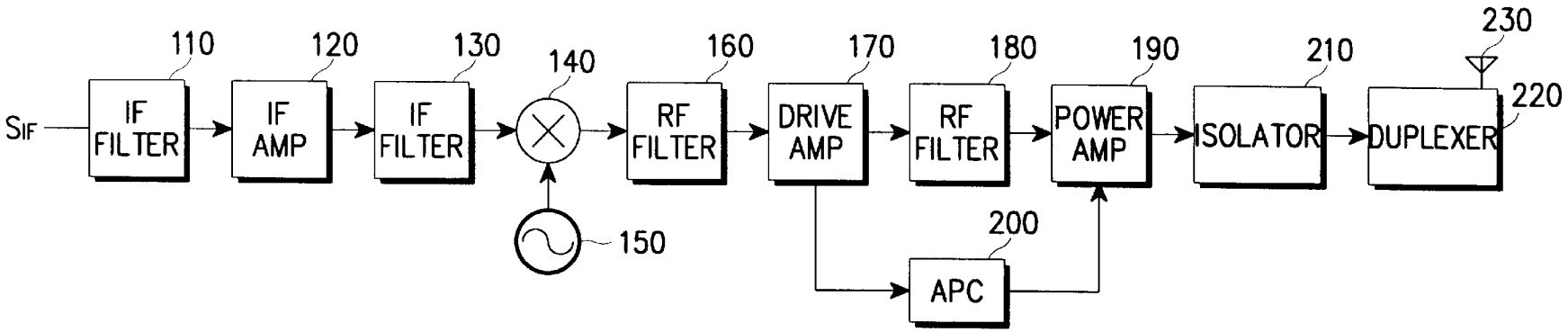
FIG. 1 PRIOR ART
FIG. 1 is a block diagram of a conventional transmitter for a terminal apparatus.
Figure 2:
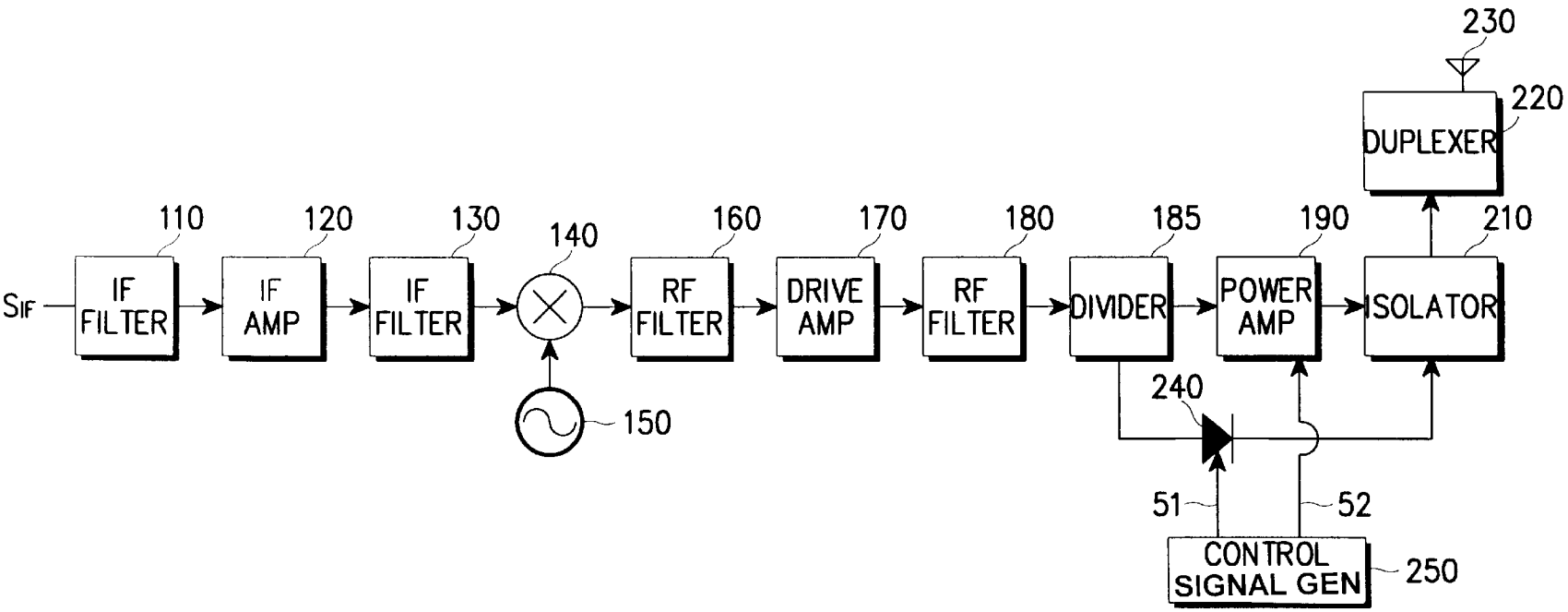
FIG. 2 is a block diagram of a transmitter for a terminal apparatus according to an embodiment of the present invention.

FIG. 2 is a block diagram illustrating a transmitter for a terminal apparatus such as a CDMA or PCS phone. An IF filter 110 receives a modulated IF input transmission signal $S_{IF}$ and filters the IF transmission signal. An IF amplifier 120 amplifies the IF transmission signal, and an IF filter 130 filters an output of IF amplifier 120. A mixer 140 mixes an output of IF filter 130 with a local oscillation frequency generated from a local oscillator 150 to generate an RF signal. An RF filter 160 filters the mixed signal to detect the RF signal. A drive amplifier 170 amplifies the RF signal in order to obtain a power signal for driving a power amplifier 190. A duplexer 220 switches an antenna 230 to a transmitting part or a receiving part. An RF filter 180 filters an output of drive amplifier 170. The power amplifier 190 amplifies the filtered RF signal.

A divider 185 divides an output of RF filter 180 into first and second power signals at the same rate. THe first power is applied to power 190, and the second power signal. is applied to a diode 240 which is forward connected between an output node of divider 185 and an input node of an isolator 210. The diode 240 may be replaced with a transistor or a switching IC (Integrated Circuit). A control signal generator 250 generates a first control signal 51 and a second control signal 52. In the case of transmitting a low power signal, control signal generator 250 activates first control signal 51 to enable diode 240 and inactivates second control signal 52 to disable power amplifier 190. On the contrary, in the case of transmitting a high power signal, control signal generator 250 inactivates first control signal 51 to disable diode 240 and activates second control signal 52 to enable power amplifier 190. The control signal generator 250 may be realized by a CPU (Central Processing Unit) or MPU (Main Processing Unit). The isolator 210, which is connected between an output node of power amplifier 190 and an input node of the duplexer 220, transfers outputs of power amplifier 190 and diode 240 to duplexer 220 without attenuation in order to prevent transmission distortion from a reflected wave.

In sum, a transmission path for a low power signal is composed of drive amplifier 170, RF filter 180 (optional), divider 185, diode 240, isolator 210, duplexer 220 and antenna 230, with power amplifier 190 being disabled. Further, a transmission path for a high power signal is composed of drive amplifier 170, RF filter 180 (optional), divider 185, power amplifier 190, isolator 210, duplexer 220 and antenna 230, with diode 240 being disabled.

As described above, when the transmitter transmits a low power signal, the power amplifier is disabled, thereby reducing the noise level, current consumption and the generation of spurious signals in the transmitter. Further, the power amplifier is enabled only when the transmitter transmits a high power signal, thereby increasing power amplifying efficiency.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A power control device in a transmitter of a radio communication system, the transmitter having a drive amplifier, a power amplifier and a duplexer, said power control device comprising:

a divider for dividing an output of the drive amplifier into first and second power signals at a same rate;

a switching element for transferring the second power signal to the duplexer in response to a first control signal, and wherein the power amplifier is enabled in response to a second control signal; and a control signal generator for generating the first and second control signals, wherein said control generator activates the first control signal to directly enable the switching element and inactivates the second control signal to directly disable the power amplifier when the transmitter transmits a low power signal, and said control signal generator inactivates the first control signal to directly enable the power amplifier when the transmitter transmits a high power signal, said first and said second control signals passing directly from said control signal generator to said switching element and said power amplifier, respectively.

2. The power control device as claimed in claim 1, wherein said switching element is a diode.

3. The power control device as claimed in claim 1, wherein said switching element is a transistor.

4. The power control device as claimed in claim 1, wherein said control signal generator is a central processing unit.

5. The power control device as claimed in claim 1, further comprising an isolator having an input node operatively coupled to the power amplifier and the switching element and an output node operatively coupled to the duplexer, for transferring outputs of the power amplifier and the switching element to the duplexer without attenuation to prevent transmission distortion from a reflected wave.

* * * * *